US005899165A

United States Patent [19]

Komura et al.

[11] Patent Number: 5,899,165

[45] Date of Patent: May 4, 1999

[54] PLATE-TYPE ANCHOR AND THE RESPECTIVE PROCESS FOR INSTALLING IT

[75] Inventors: Adolfo Tsuyoshi Komura; Gester Filgueiras, Jr., both of Macaé (RJ), Brazil

[73] Assignee: Petroleo Brasileiro S.A.—Petrobras, Rio de Janeiro, Brazil

[21] Appl. No.: 08/917,778

[22] Filed: Aug. 27, 1997

[30] Foreign Application Priority Data

Aug. 30, 1996 [BR] Brazil ..... PI9603600

[51] Int. Cl.[6] ..... B63B 21/24

[52] U.S. Cl. ..... 114/294

[58] Field of Search ..... 114/293, 294, 114/230, 297, 295, 300, 301; 441/3–5

[56] References Cited

U.S. PATENT DOCUMENTS

| | | | |
|---|---|---|---|
| 3,372,665 | 3/1968 | Mesler . | |
| 3,653,167 | 4/1972 | Menard . | |
| 3,750,609 | 8/1973 | Chelminski . | |
| 3,889,621 | 6/1975 | Pease | 114/294 |
| 3,931,782 | 1/1976 | Childers et al. | 114/294 |
| 4,356,788 | 11/1982 | Stern et al. . | |
| 4,682,559 | 7/1987 | Schnitzer et al. | 114/295 |
| 4,688,360 | 8/1987 | Luong et al. . | |
| 4,869,193 | 9/1989 | Van Den Haak | 114/294 |
| 4,966,079 | 10/1990 | Humphrey . | |
| 5,353,732 | 10/1994 | Gramet et al. . | |
| 5,542,368 | 8/1996 | Yoshioka | 114/294 |

FOREIGN PATENT DOCUMENTS

| | | |
|---|---|---|
| 9206838 | 11/1991 | Brazil . |
| 0161190 | 11/1985 | European Pat. Off. . |
| 2652366 | 3/1991 | France . |
| 168099 | 3/1906 | Germany . |
| 2089862 | 6/1982 | United Kingdom . |
| WO8703260 | 6/1987 | WIPO . |
| WO9311028 | 6/1993 | WIPO . |

*Primary Examiner*—Stephen Avila
*Attorney, Agent, or Firm*—Sughrue, Mion, Zinn, Macpeak & Seas, PLLC

[57] ABSTRACT

A plate-type anchor includes a flat sheet forming a central portion of substantially rectangular shape, provided with lateral flanges with a certain inclination with respect to the plane of the principal sheet, a flange corresponding to the front part of the anchor being of pointed shape while the flange corresponding to the tail of the anchor has a cut-out to allow fitting of a device to be used when it is launched. On its upper face, the anchor is provided with two longitudinally hollowed-out lugs which are mutually parallel and fastened perpendicularly to the face of the flat sheet, and to which the chain cables or mooring cables of the anchor are attached. On the lower face are fastened two longitudinal bars perpendicular to the plane of the face, but forming an acute angle towards the front part of the anchor. The anchor is installed in the sea bed with the aid of a device in the form of a pile, provided, at its lower end, with a device for fastening the anchor, the pile/anchor assembly being launched from a vessel and reaching the sea bed through the action of its own weight.

7 Claims, 10 Drawing Sheets

PLATE-TYPE ANCHOR AND THE RESPECTIVE PROCESS FOR INSTALLING IT

FIELD OF THE INVENTION

The present invention relates to a device for anchoring floating structures, particularly a floating platform for carrying out operations in deep waters.

BACKGROUND OF THE INVENTION

The conventional anchoring system was based on the idea of keeping a floating structure in position by means of anchoring lines, which included a chain cable with an anchor at its end, driven into the sea bed so as to be able to support horizontal loads. A set of 8 to 16 anchoring lines were deployed in series from the superstructure of the platform to the sea bed.

With the development of technologies for deep water oil recovery, it is becoming increasingly important to reduce the weight of the anchoring system on the deck of the platform and to reduce the amount of space occupied on the sea bed by the said anchoring system. As a result of these requirements, the so-called "taut-leg" system therefore came into being.

In this "taut-leg" system, a fixed point on the sea bed is needed, to which point the anchoring line for supporting vertical loads will be fastened, and use is made of elastic lines instead of a catenary of inextensible chain cables.

A number of devices have been suggested as the fixed point on the sea bed, the most commonly used by specialists in the field being piles and anchors.

Piles are fastened to the sea bed by driving or by drilling with a bore. Both technologies are sufficiently well known to the expert in the art.

Anchors may be classified into two main categories: suction anchors and vertical-load anchors.

Suction anchors comprise devices which are reminiscent of the shape of an inverted cup, which buries itself in the sea bed as a vacuum is formed inside it.

Vertical-load anchors (VLAs) generally consist of a flat sheet in various formats, these being driven into the sea bed by means of dragging, exerted on their mooring cable, until they reach the ideal position for supporting the vertical loads which will be required of them.

- a pointed front part of the anchor;
- a cut-out in the portion corresponding to the tail of the anchor to allow fitting of a device used to launch the anchor;
- two longitudinally hollowed-out lugs mutually parallel extending perpendicularly from the upper face of the central portion of the flat sheet, and to which the mooring cables of the anchor will be attached;
- on the lower face of the central portion, two longitudinal bars extending perpendicular to the plane of the face, and convergent at an acute angle towards the front part of the anchor;
- two vertical slots provided at the upper ends of the said lugs, nearer to the tail than to the front part of the anchor, in which shackles for fastening the mooring cables of the tail of the anchor will be accommodated;
- two longitudinal slots which extend from the central portion of said lugs as far as the lower ends thereof, for receiving the shackles for mooring the cables of the anchor front part; and

- shearable pins in said longitudinal slots for limiting the travel of said shackles.

A second aspect of the invention comprises a process for deploying the anchor of the first aspect using a launching device, characterized in that it comprises the steps of:

a) taking the assembly formed by said launching device connected to said anchor on board a first vessel to the launching location;

b) passing an anchoring line of the anchor to a second vessel located close to the launching location, the launching device having a support cable which is kept attached to the first vessel;

c) lowering the said assembly, attached to its respective cables, down to a level spaced above the sea bed and releasing the support cable of the launching device to allow the assembly to drop under gravity and to penetrate the sea bed;

d) recovering the launching device of the anchor and bringing it on board the said first vessel;

e) dragging the said anchoring line of the anchor with the aid of the second vessel until the face of the anchor adopts a position which is perpendicular to the anchoring line, guaranteeing the grip necessary for anchoring the movable structure;

f) attaching the end of the anchoring line to a marker buoy for holding it until the movable structure arrives at the location; and g) recovering the anchoring line with the aid of the buoy and of a vessel and connecting said anchoring line to the hawsers of the said movable structure, and releasing the marker buoy.

The body of the pile is filled with a heavy material, for example cast iron, haematite, concrete, etc.

DETAILED DESCRIPTION OF THE INVENTION

To assist understanding of the invention, it will be described in conjunction with the Figures which accompany this specification. However, it should be pointed out that the Figures illustrate only one embodiment of the invention which does not therefore limit the scope of the invention. It will be apparent to the expert in the art that, within the scope of claims, it is possible to use anchors of different formats.

Figure 1:
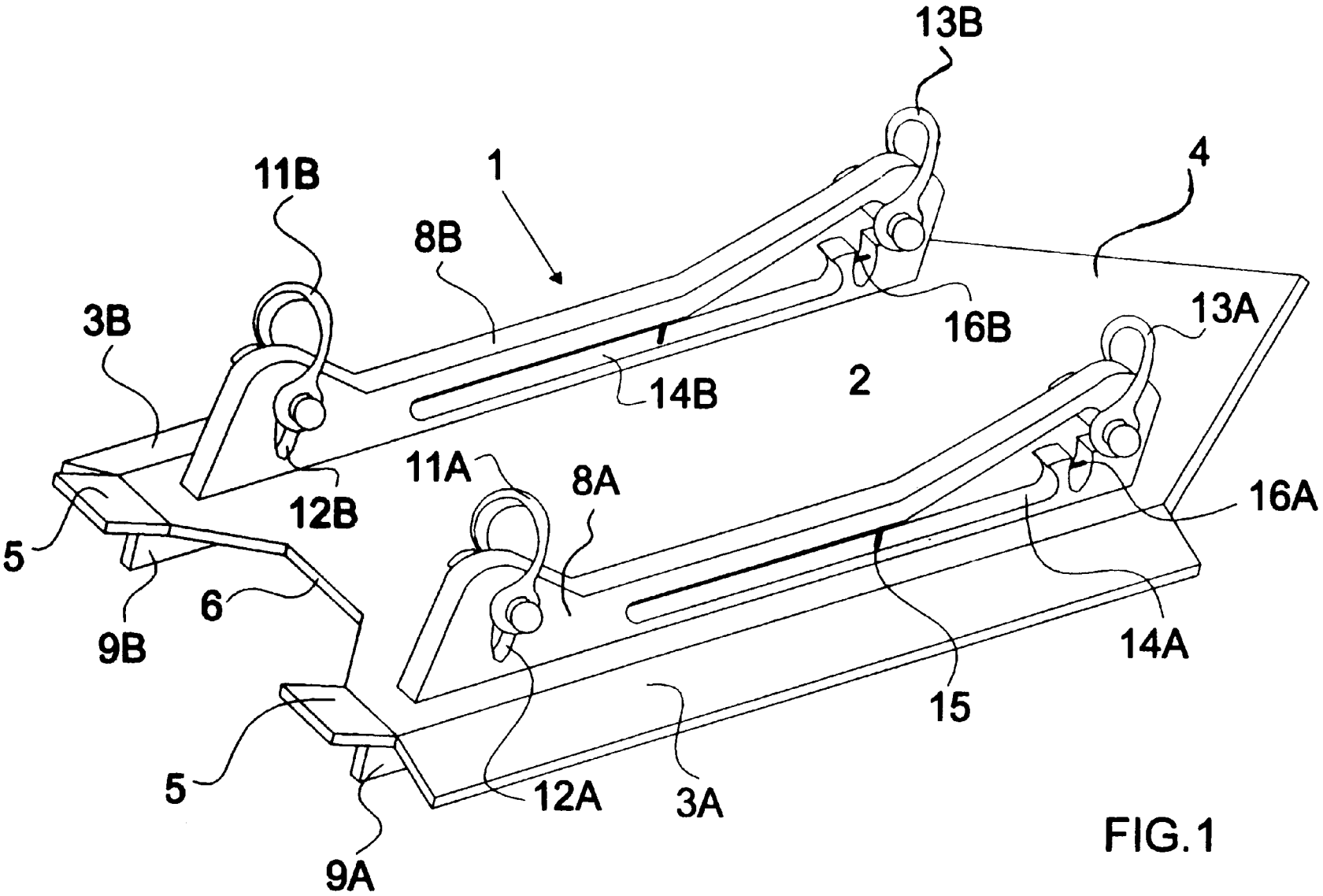
FIG. 1 shows a perspective view of an embodiment of the anchor of the invention.
Figure 2B:
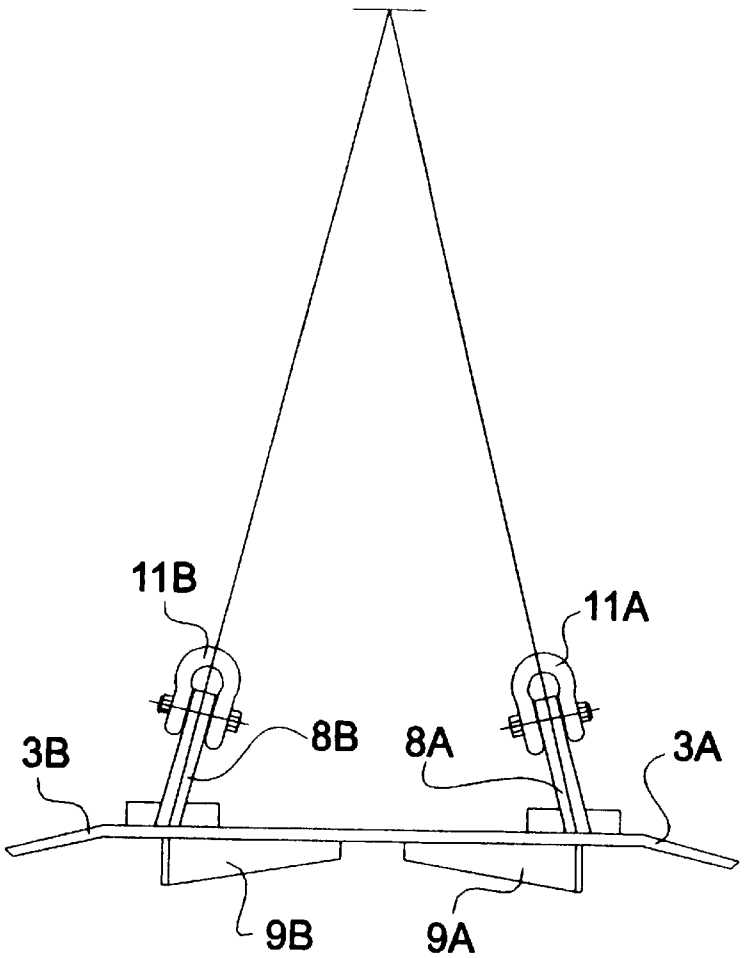
FIGS. 2A and 2B show the anchor of FIG. 1 in lateral view and in rear view.
Figure 2A:
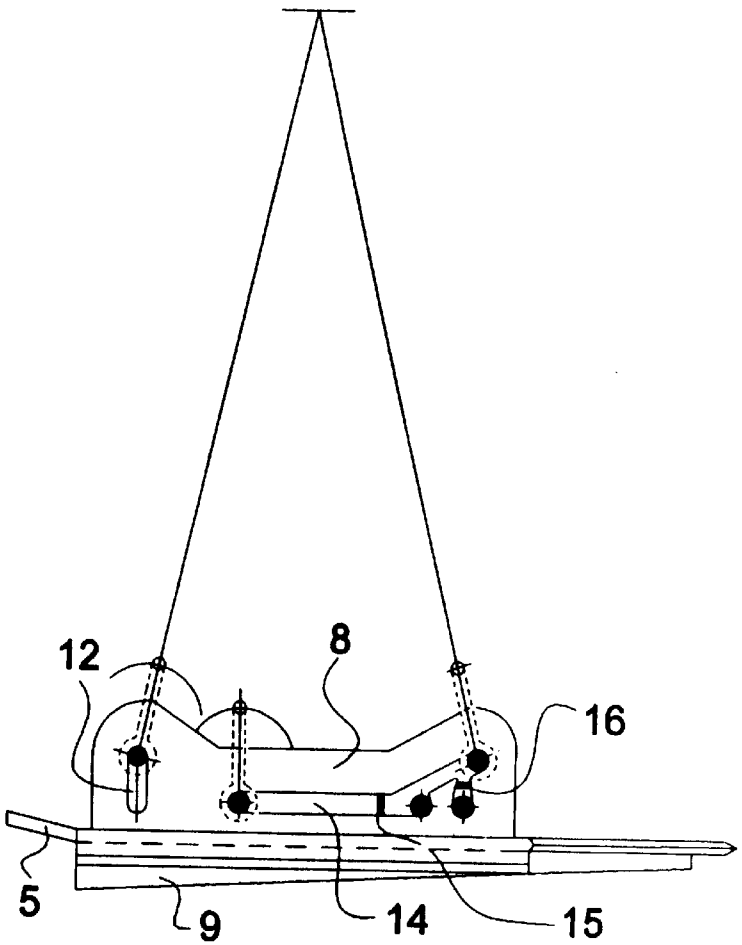

As may be seen in FIGS. 1 and 2, the anchor 1 comprises a flat sheet forming a central portion 2 of substantially rectangular shape, provided with lateral flanges 3*a*, 3*b* with a certain inclination with respect to the plane of the central portion 2 of the flat sheet. The flange 4, corresponding to the front part of the anchor 1, has a pointed shape whilst the flange 5 located in the portion corresponding to the tail of the anchor forms a cut-out 6 to allow fitting of a device 7—shown in greater detail in FIG. 3—to be used when it is launched.

On its upper face, the anchor 1 is provided with two longitudinally hollowed-out lugs 8*a*, 8*b* which are mutually parallel and are perpendicular with respect to the central portion 2 of the flat sheet, and to which the chain cables or mooring cables of the anchor will be attached (shown below). Fastened on the lower face of the central portion 2 are two longitudinal bars 9*a*, 9*b* perpendicular to the plane of the lower face, but converging at an acute angle towards the front part of the anchor 1. The hollowed-out part of the lugs 8*a*, 8*b* has a special shape for accommodating shackles 11*a*, 11*b*, 13*a*, 13*b* to which the chain cables or anchor cables will be fastened.

The shackles 11*a*, 11*b* of the tail part are each accommodated in a respective vertical slot 12*a*, 12*b* located close to the upper ends of the lugs 8*a*, 8*b*, whilst the shackles 13*a*, 13*b* of the front part of the anchor are accommodated close to the lower ends of the same lugs in a longitudinal slot 14*a*, 14*b*, their travel being however limited by shearable pins 15*a*, 11*b*, 16*a*, 16*b*.

Figure 3:
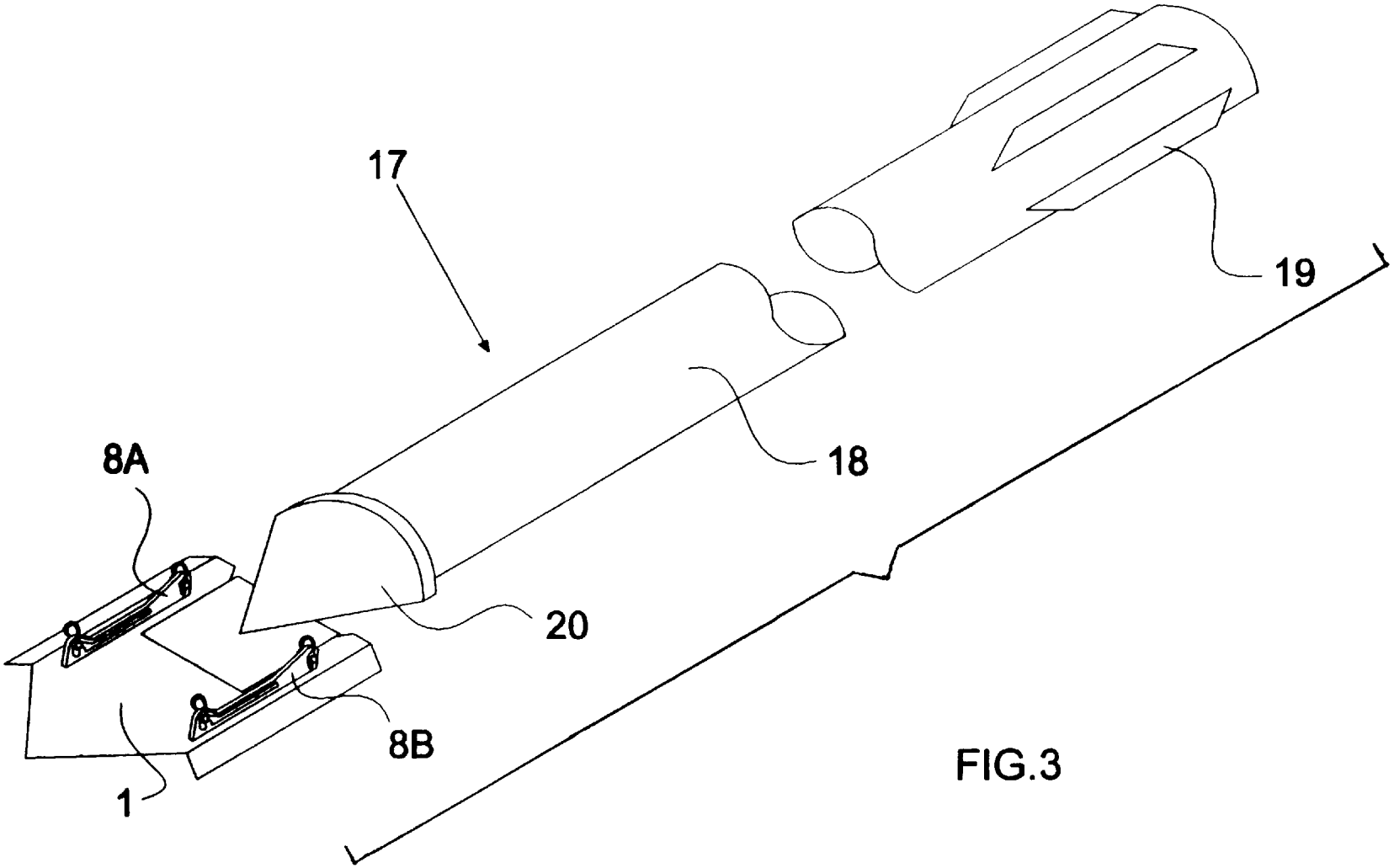
FIG. 3 shows a perspective view of the launching device with the anchor fixed at its lower end.
Figure 4B:
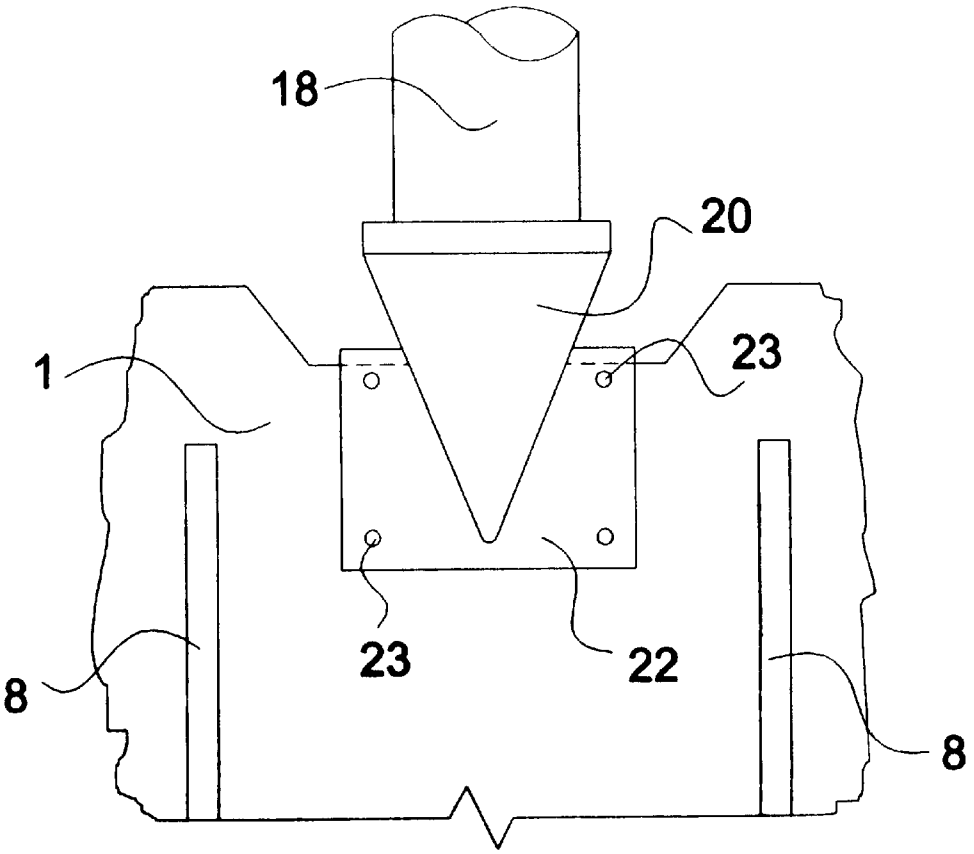
FIGS. 4A and 4B show, in lateral and front views, details of the way in which the anchor is connected to the launching device.
Figure 4A:
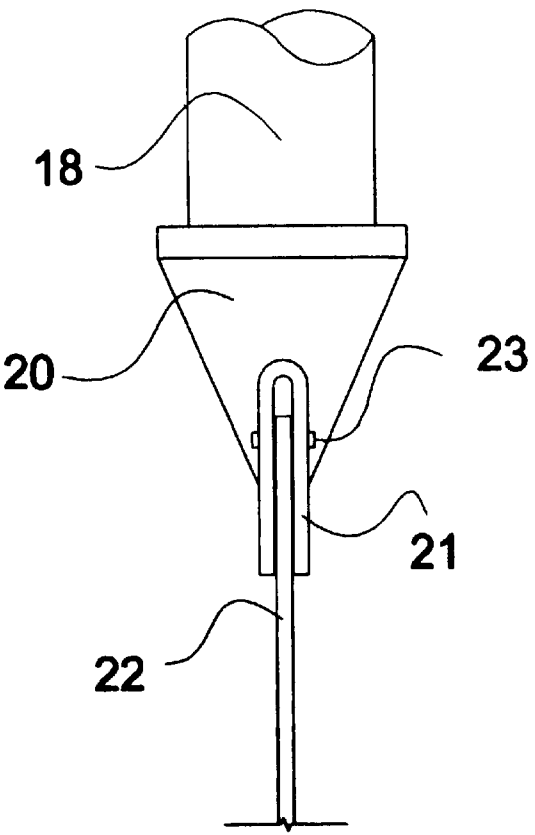
Figure 5:
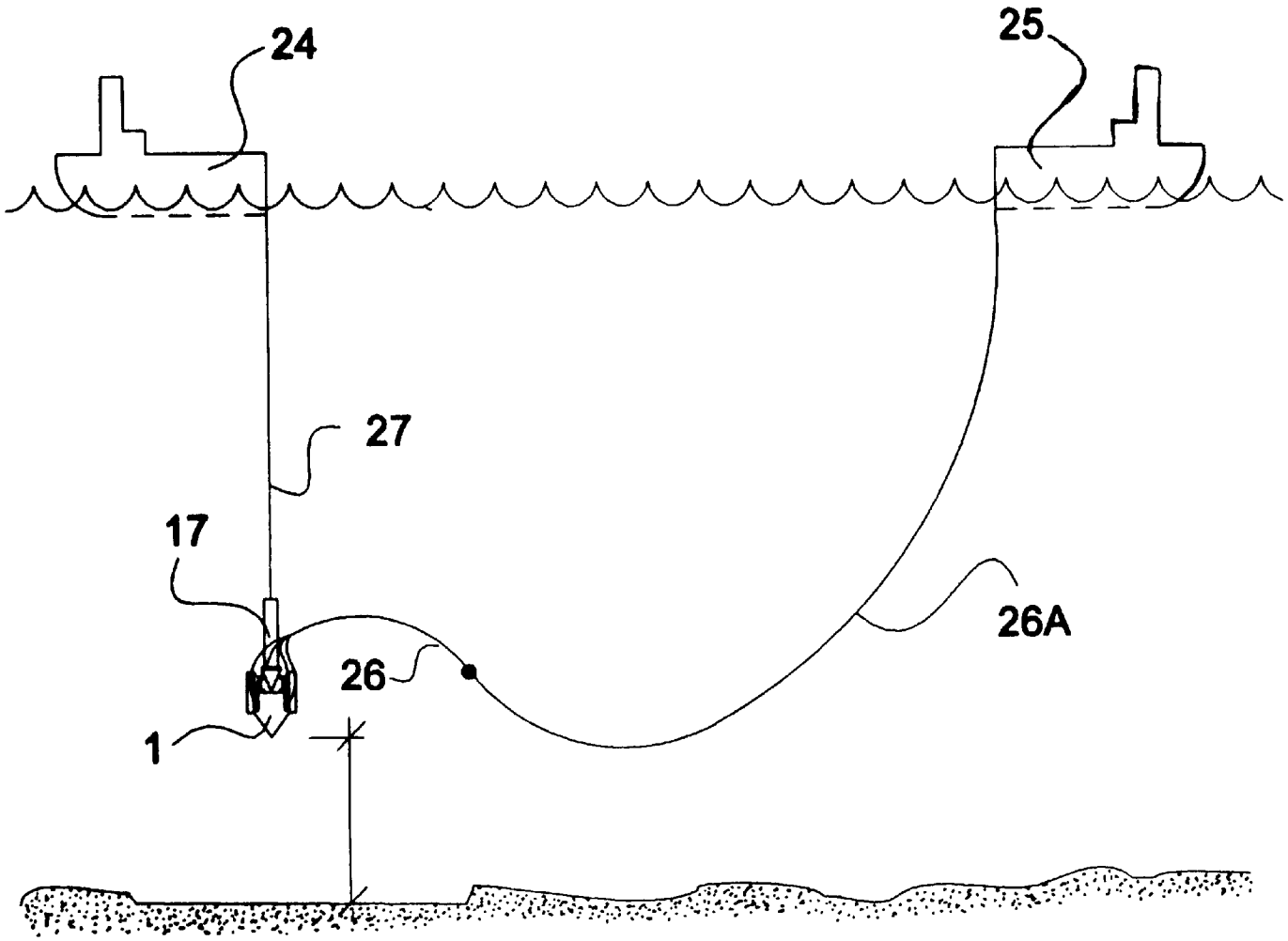
FIGS. 5 to 10 show the steps in the process for deploying the anchor.

FIGS. 3 and 4 show details of the device 7 used to assist in launching the anchor 1 according to the invention. Use is made of a pile 17 which comprises a substantially cylindrical body 18, pre-filled with weights such as blocks of cast iron, iron ore, etc., having stabilizing fins 19 at its upper end and a substantially conical tip 20 at its lower end, this point 20 being provided with means 21 for fastening to the anchor 1; the means 21 may for example be a sheet 22 attached to the anchor sheet by means of four shearable pins 23 but slightly set back from the tip of the pile 17. With the impact on the sea bed of the assembly formed by the anchor 1 and the pile 17, the pins 23 will rupture, releasing the pile 17 which may be recovered later for re-use.

The assembly is launched using vessels of the tug type by allowing the pile, carrying the anchor at its tip, to drop under gravity from a predetermined height so that the anchor achieves the desired penetration depth. The stages in the process for installing the anchor will be described in detail in conjunction with FIGS. 5 to 10.

A first tug 24, carrying on board the pile 17 and the anchor 1 already prepared for launching, arrives at the desired location. A second tug 25 is kept close by, with the joined ends of the anchor cables 26 attached to it to form an anchoring line 26A, by means of which the anchor 1 will be suitably positioned after it has been driven into the sea bed.

Figure 6:
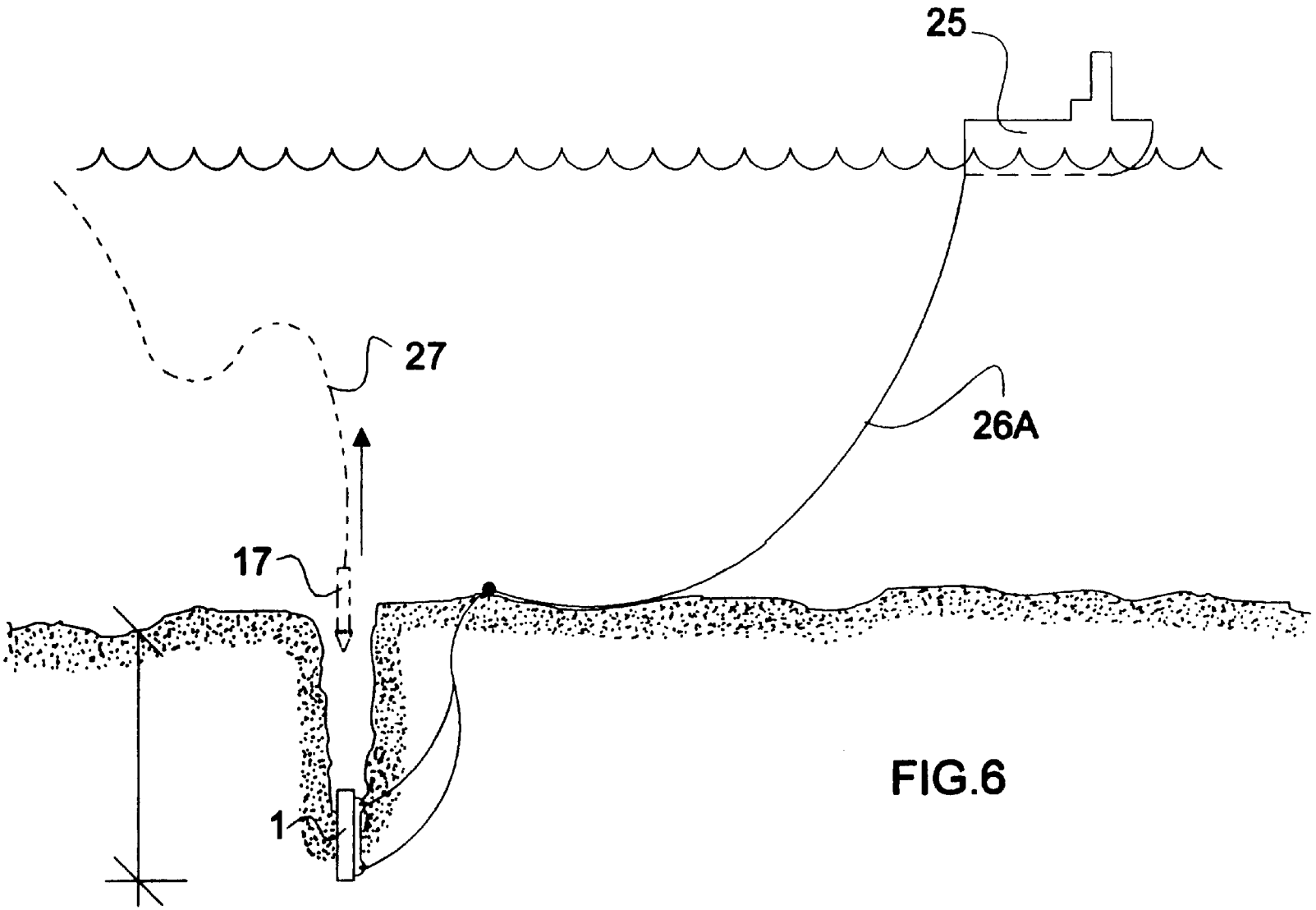

The pile/anchor assembly is lowered vertically from the tug 24 down to a desired height above the sea bed (FIG. 5), generally in the region of 50–60 metres. Its support cable 27 is then released and the assembly is allowed to drop under gravity. When the anchor 1 contacts the sea bed, the ensuing impact causes the fastening pins 23 of the sheet 22 which hold the anchor on the pile 17 to break by shearing, thereby releasing the pile 17 for recovery by the tug 24 by raising of the support cable 27. This impact also helps to thrust the anchor 1 downwards, facilitating its penetration into the sea bed (as shown in FIG. 6).

Figure 7:
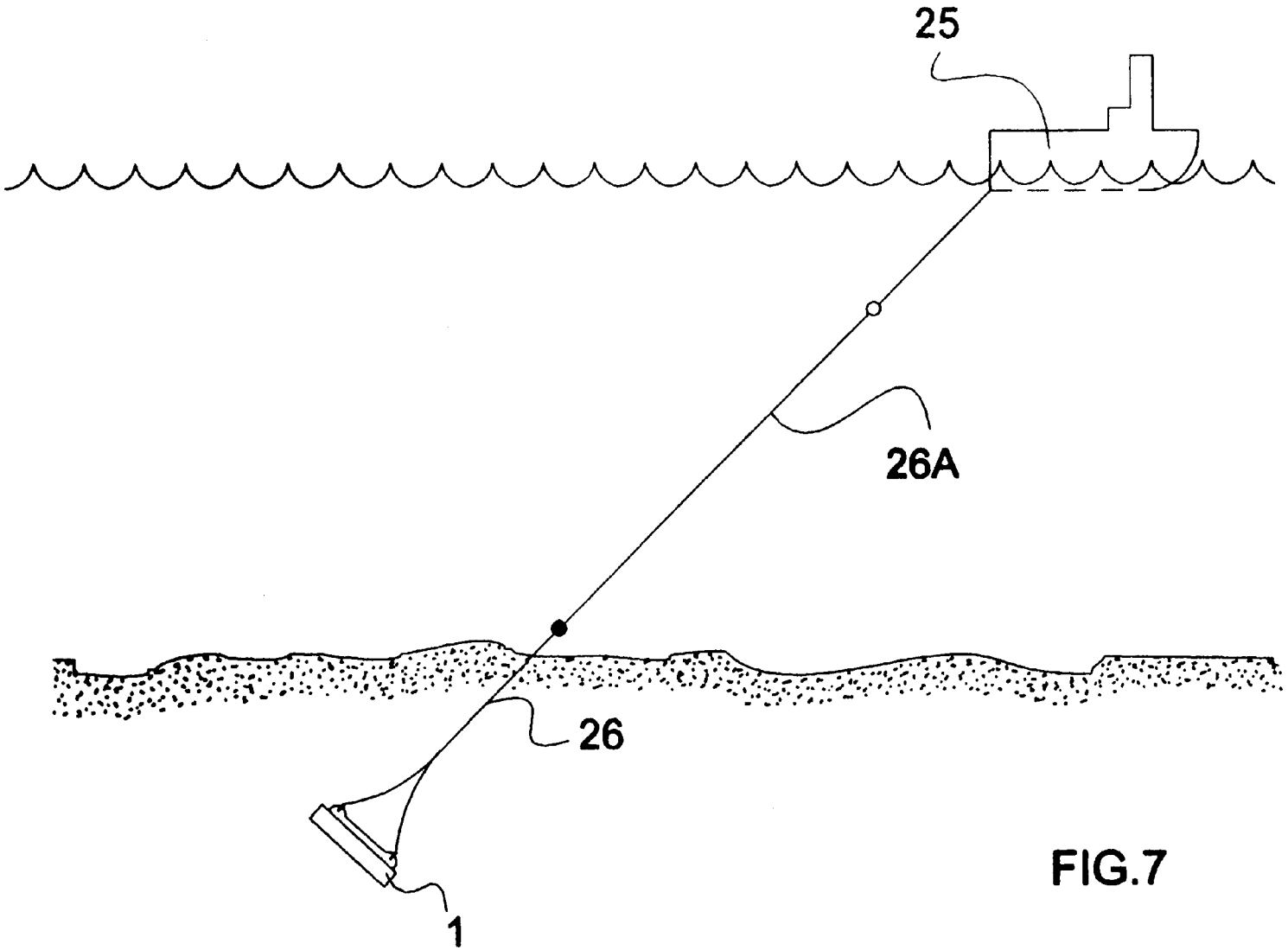
Figure 8:
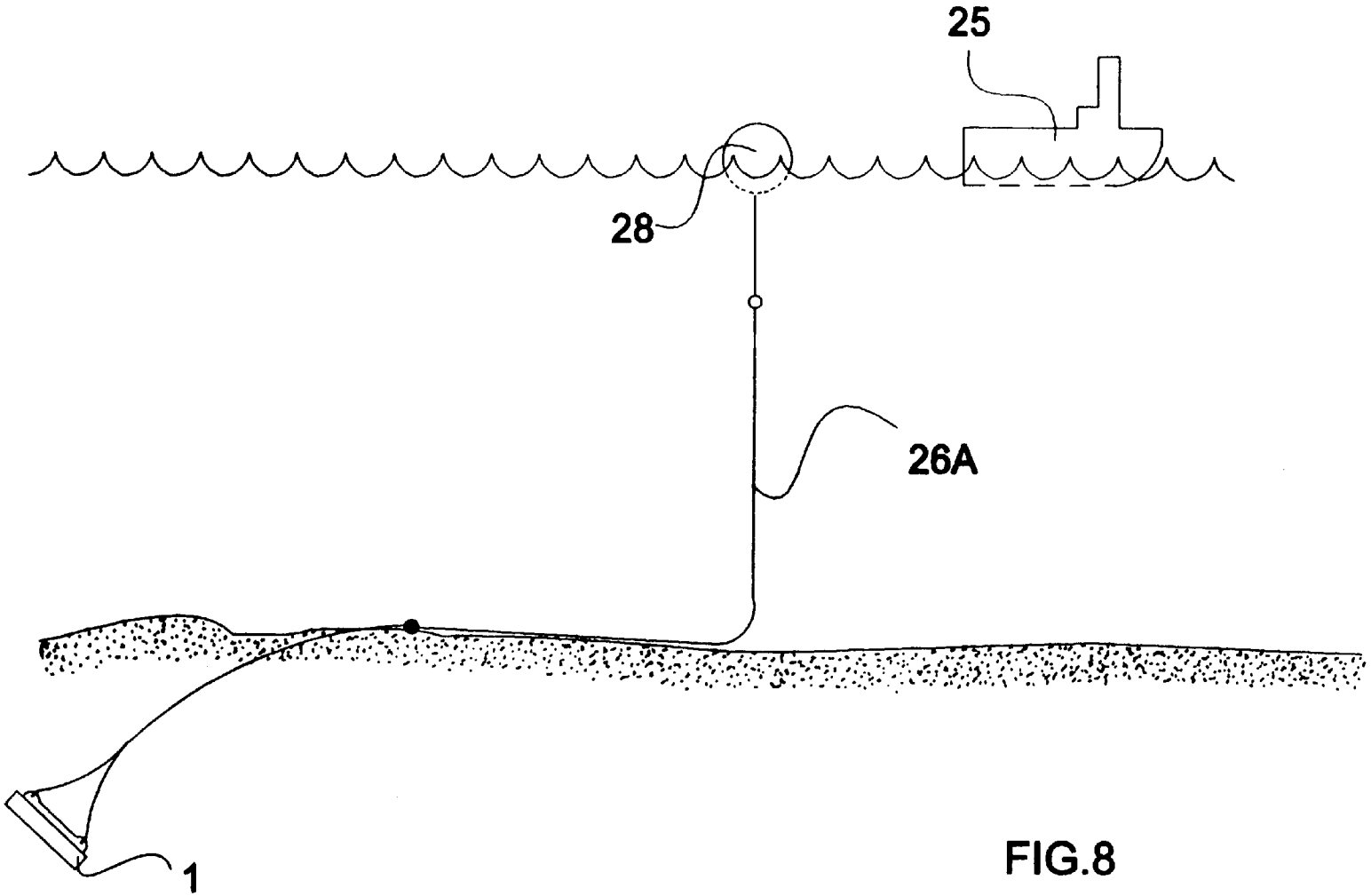

As shown in FIG. 7, once buried in the sea bed the anchor 1 is then dragged by the tug 25 pulling on the anchoring line 26A, causing the anchor to become lodged in the sea bed and allowing it to adopt a suitable position which guarantees the grip necessary for anchoring the movable structure 29 still to be towed to the desired location. This position is normally achieved when the anchoring line 26A adopts a position perpendicular to the face of the anchoring plate 1.

The mooring line 26A is ten attached to a marker buoy 28 (FIG. 8) until the movable structure 29 arrives at the desired location, by which time all the necessary anchors will have been installed. The tug 25 is then free to carry out other operations.

Figure 9:
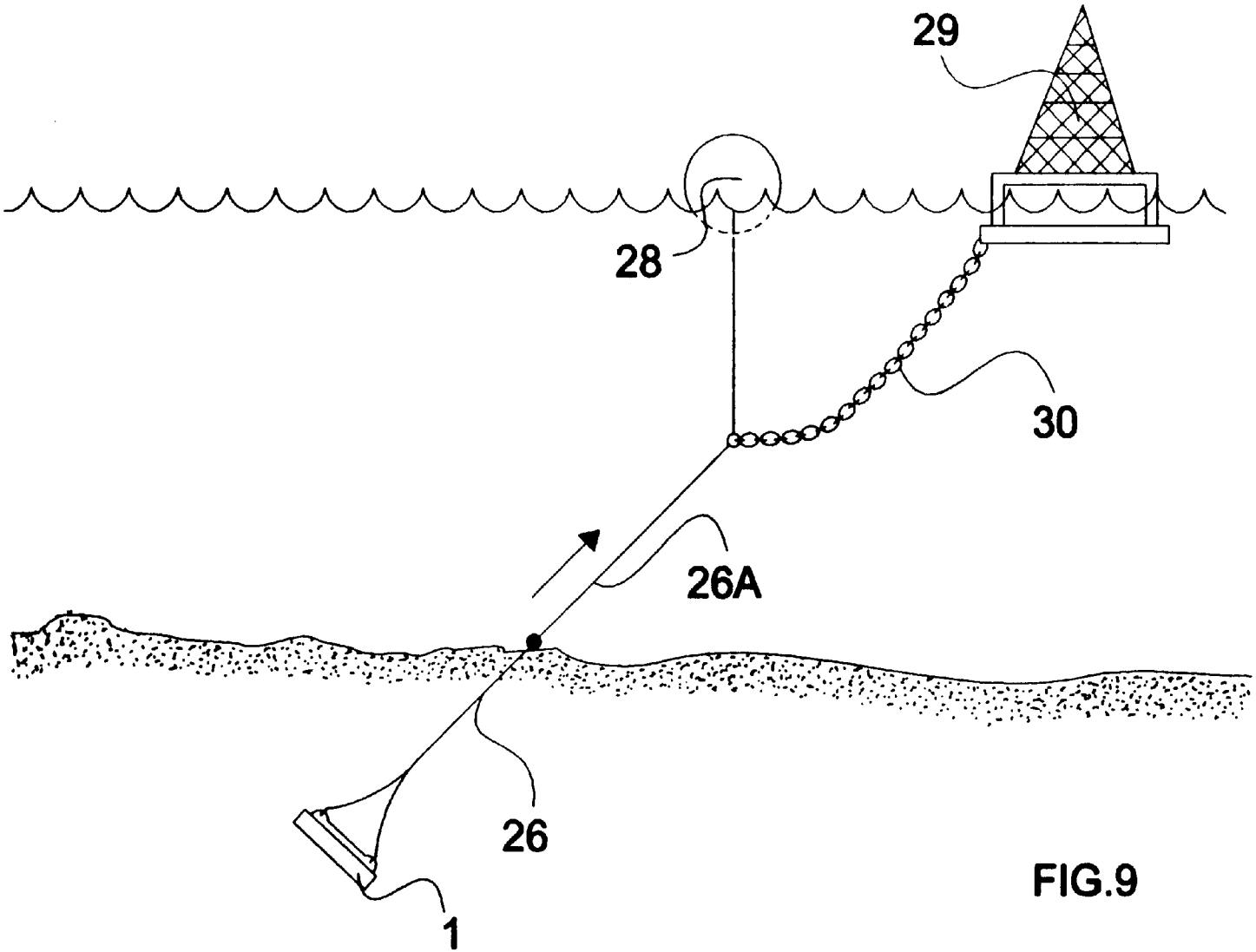

When, as shown in FIG. 9, the movable structure 29 arrives at the desired location the buoys 28 are located visually, which enables the support vessel, generally a tug, to approach the buoys 28, to recover the anchoring lines 26A of the anchors, and to form the connection with the hawsers 30 of the movable structure 29.

Figure 10:
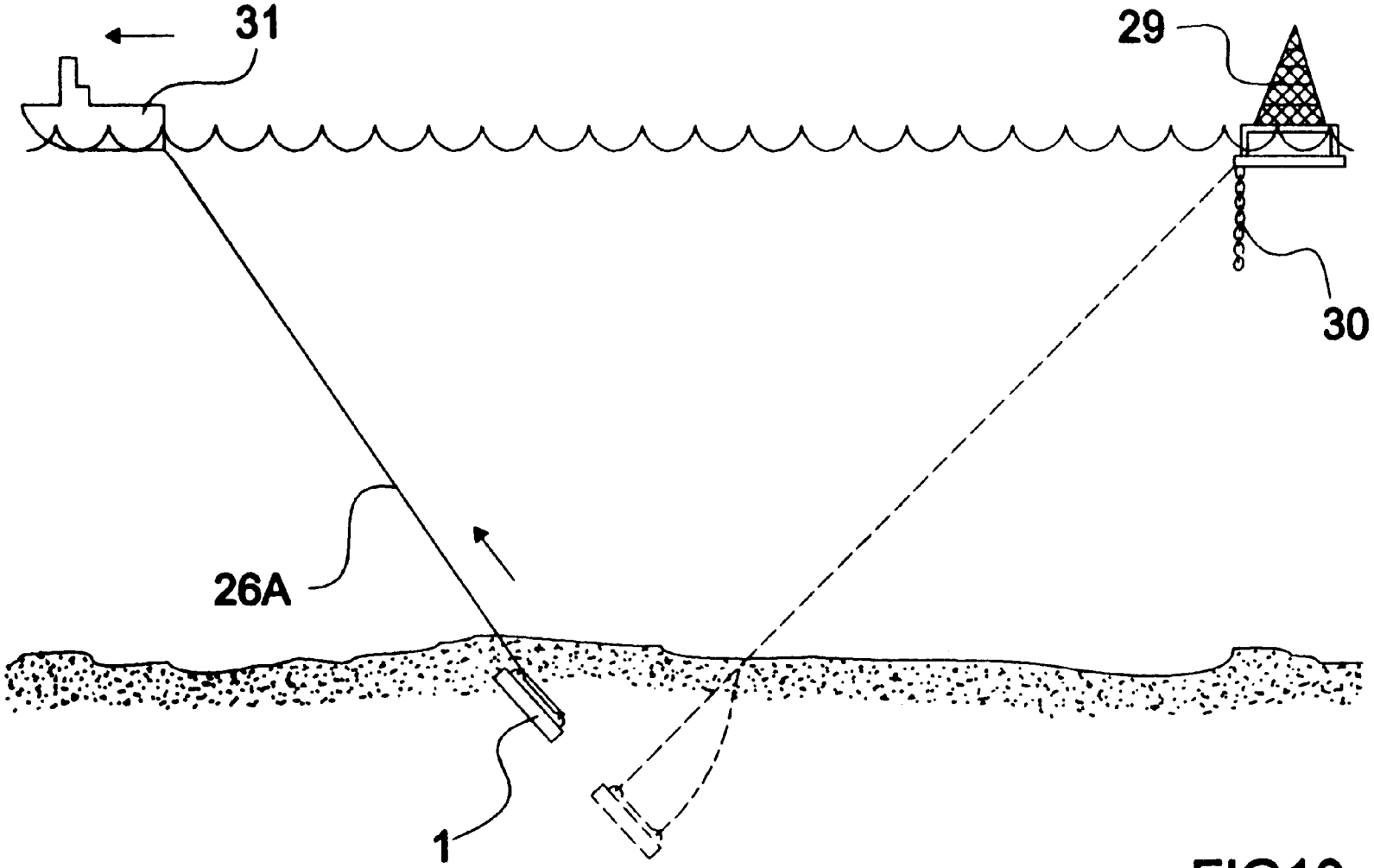

When it is desired to remove the movable structure 29 from the location, the conventional operations normally performed by specialists may be applied. As shown in FIG. 10, the hawsers 30 of the movable structure and the anchoring lines 26A are disconnected, releasing the structure 29. The anchoring line 26A is passed to a tug 31 which will drag it in the opposite direction from that adopted when the anchor 1 was installed, leading to removal and later recovery of the anchor.

The simplicity of the launching operations and the precision with which the installation point for the anchor is achieved without interfering with neighbouring installations give the present invention a major advantage when compared with similar devices known hitherto, since it is unnecessary to drag the anchor over the sea bed.

We claim:

1. Plate-type anchor, characterized in that it comprises:

a flat sheet having a central portion (2) of substantially rectangular shape, provided with lateral flanges (3*a*, 3*b*) inclined with respect to the plane of the sheet (2);

a pointed front part (4) of the anchor (1);

a cut-out (6) in the portion corresponding to the tail of the anchor to allow fitting of a device (7) used to launch the anchor;

two longitudinally hollowed-out lugs mutually parallel (8*a*, 8*b*) extending perpendicularly from the upper face of the central portion (2) of the flat sheet, and to which the mooring cables (26) of the anchor will be attached;

on the lower face of the central portion (2), two longitudinal bars (9*a*, 9*b*) extending perpendicular to the plane of the face, and convergent at an acute angle towards said front part of the anchor (1);

two vertical slots (12*a*, 12*b*) provided at the upper ends of said lugs (8*a*, 8*b*), nearer to said tail than to said front part of the anchor, in which shackles (11*a*, 11*b*) for fastening the mooring cables of the tail of the anchor will be accommodated;

two longitudinal slots (14*a*, 14*b*) which extend from the central portion of said lugs (8*a*, 8*b*) as far as the lower ends thereof, for receiving the shackles (13*a*, 13*b*) for mooring the cables of the anchor front part; and shearable pins (15*a*, 15*b*, 16*a*, 16*b*) in said longitudinal slots (14*a*, 14*b*) for limiting the travel of said shackles (13*a*, 13*b*).

2. Platetype anchor according to claim 1, in combination with a device (7) for launching it towards the sea bed, characterized in that said launching device (7) comprises a pile (17) in the form of a substantially cylindrical body (18) having, close to a first end thereof, stabilizing fins (19) and a support cable (27) and, at its second end, a substantially conical tip (20) which is provided with means (21) for fastening to the anchor (1).

3. Combination according to claim 2, characterized in that said means (21) for fastening to the anchor (1) comprises a sheet (22) slightly set back from the second end of the pile (17), and attachable to the anchor by means of four pins (23).

4. Combination according to claim 2, characterized in that the body of the said launching device (7) is ballasted with a weight.

5. Process for deploying a plate-type anchor using a launching device, characterized in that it comprises the steps of:

a) taking the assembly formed by said launching device (7) connected to said anchor (1) on board a first vessel (24) to the launching localition;

b) passing an anchoring line (26A) of the anchor to a second vessel (25) located close to the launching location, the launching device (7) having a support cable (27) which is kept attached to the first vessel (24);

c) lowering the said assembly, attached to its respective cables, down to a level spaced above the sea bed and releasing the support cable (27) of the launching device (7) to allow the assembly to drop under gravity and to penetrate the sea bed;

d) recovering the launching device (7) of the anchor (1) and bringing it on board the said first vessel (24);

e) dragging the said anchoring line (26A) of the anchor (1) with the aid of the second vessel (25) until the face of the anchor adopts a position which is perpendicular to the anchoring line, guaranteeing the grip necessary for anchoring a movable structure (29);

f) attaching the end of the anchoring line (26A) to a marker buoy (28) for holding it until the movable structure (29) arrives at the location; and g) recovering the anchoring line (26A) with the aid of the buoy (28) and of a vessel and connecting said anchoring line to the hawsers (30) of the said movable structure, and releasing the marker buoy.

6. Process according to claim 5, characterized by allowing the anchor (1) to penetrate the sea bed without dragging it.

7. Process according to claim 5, characterized in that, before step (c), the anchor (1) and the launching device (7) are connected together by rupturable means which on impact of the assembly with the sea bed release the anchor (1) from the launching device (7) and allows the actual anchor (1) to be recovered.

* * * * *